US008365672B2

(12) United States Patent
Calero Martinez et al.

(10) Patent No.: US 8,365,672 B2
(45) Date of Patent: Feb. 5, 2013

(54) FRANGIBLE BULLET AND ITS MANUFACTURING METHOD

(75) Inventors: Jose Antonio Calero Martinez, Barcelona (ES); Joan Morato Ribas, Barcelona (ES); Luis Allut Grillot, Barcelona (ES)

(73) Assignee: Aleaciones de Metales Sinterizados, S.A., Barcelona (ES)

( * ) Notice: Subject to any disclaimer, the term of this patent is extended or adjusted under 35 U.S.C. 154(b) by 16 days.

(21) Appl. No.: 12/731,704

(22) Filed: Mar. 25, 2010

(65) Prior Publication Data

US 2010/0242778 A1 Sep. 30, 2010

Related U.S. Application Data

(60) Provisional application No. 61/163,252, filed on Mar. 25, 2009.

(51) Int. Cl.
*F42B 30/02* (2006.01)

(52) U.S. Cl. ..... 102/517; 102/506; 86/54

(58) Field of Classification Search ..... 102/501, 102/506, 517; 86/54, 55, 57
See application file for complete search history.

(56) References Cited

U.S. PATENT DOCUMENTS

| | | | | |
|---|---|---|---|---|
| 5,237,930 | A | 8/1993 | Belanger et al. | |
| 5,399,187 | A | 3/1995 | Mravic et al. | |
| 5,616,642 | A * | 4/1997 | West et al. | 524/439 |
| 5,760,331 | A | 6/1998 | Lowden et al. | |
| 5,894,644 | A | 4/1999 | Mravic | |
| 5,950,064 | A | 9/1999 | Robinson et al. | |
| 6,016,754 | A | 1/2000 | Enlow et al. | |
| 6,074,454 | A | 6/2000 | Abrams et al. | |
| 6,090,178 | A | 7/2000 | Benini | |
| 6,263,798 | B1 | 7/2001 | Benini | |
| 6,439,124 | B1 | 8/2002 | Enlow et al. | |
| 6,536,352 | B1 | 3/2003 | Nadkarni et al. | |
| 6,551,375 | B2 | 4/2003 | Siddle et al. | |
| 6,569,381 | B2 | 5/2003 | Le Floc'h et al. | |
| 6,815,060 | B2 | 11/2004 | Yuuki | |
| 7,353,756 | B2 | 4/2008 | LeaSure | |
| 7,392,746 | B2 * | 7/2008 | Hansen | 102/517 |
| 7,555,987 | B2 * | 7/2009 | Powers, Jr. | 102/506 |

* cited by examiner

*Primary Examiner* — James Bergin
(74) *Attorney, Agent, or Firm* — Ostrolenk Faber LLP

(57) ABSTRACT

This invention describes a frangible bullet made from particles of a copper-based metal powder with the aid of an organic lubricant, which have been pressed so that the pressed particles have a density of more than 6.9 g/cm$^3$, where the composition has been treated with thermal oxidation.

8 Claims, 1 Drawing Sheet

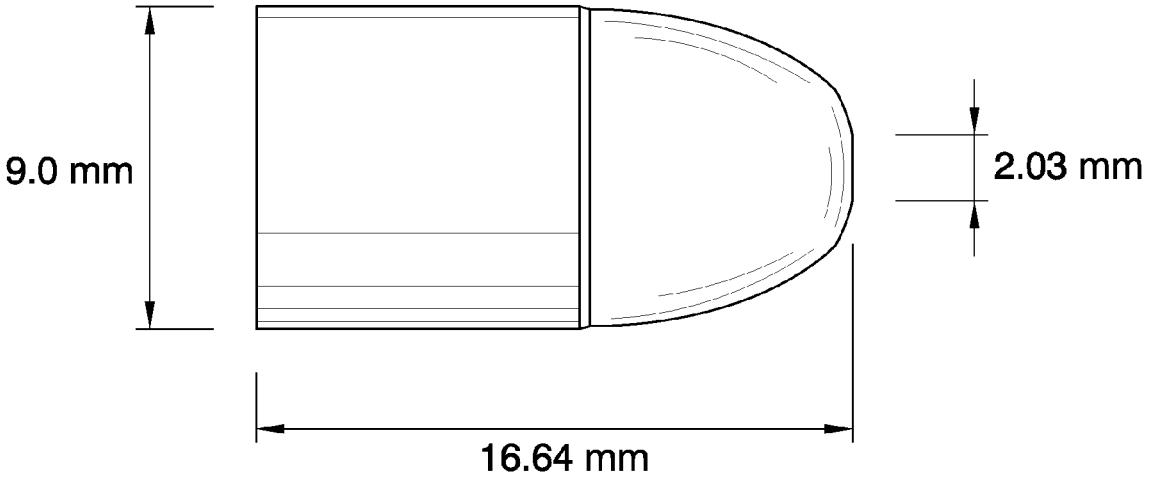
9.0 mm
2.03 mm
16.64 mm

FRANGIBLE BULLET AND ITS MANUFACTURING METHOD

CROSS-REFERENCE TO RELATED APPLICATIONS

This application claims the benefit under 35 U.S.C. §119 (e) of U.S. Provisional Patent Application Ser. No. 61/163,252, entitled PRODUCTION OF FRANGIBLE BULLETS BY UNIAXIAL COLD COMPACTION, filed 25 Mar. 2009 by the present inventive entity, the entire contents and disclosure of which are hereby incorporated by their reference for all purposes.

FIELD OF THE INVENTION

This invention is related to the techniques used in the manufacture of bullets, ammunition and projectiles, and more specifically it is related to a frangible bullet and its manufacturing method, the bullet comprising particles of a copper base material compacted with the aid of an organic lubricant.

BACKGROUND OF THE INVENTION

Lead is the most common component in pistol bullets, given its high density, plasticity and low cost. However, its high toxicity both for the environment and for the person firing the bullet, together with its tendency to generate fumes and small particles during shooting has originated the search for more ecological alternatives that maintain the low cost.

During shooting exercises there is a potential risk of being wounded by ricocheting bullets. When the bullet impacts on a surface with a certain angle there is the possibility that not all of the kinetic energy it carries dissipates by breaking or deforming the bullet, that is, part of this energy may remain in the deformed bullet or in a fragment of the bullet, possibly causing undesired injury or collateral damage to other people or objects.

This effect may be avoided or minimised by making the bullet more "frangible", that is, by making it easier for the bullet to break into small parts when it impacts on its main target, such that the energy associated to these tiny fractions of the bullet is very small and the collateral damage they may cause is minimal.

Methods have been developed in the prior art to manufacture frangible bullets by pressing and heat treating stainless steel or other partially alloyed steels with copper base materials.

Most known processes are based on the use of a metal "adhesive" that melts at low temperatures and distributes itself within the base material matrix by capillarity. In the case of copper based materials, the system is supplemented with the formation of superficial Cu—Sn intermetallic bonds that both facilitate the resistance of the material when "sheathed" inside the cartridge and ensure frangibility when fired.

One example of a material and process for the manufacture of frangible bullets is found in U.S. Pat. No. 6,074,454, which uses a copper-based powder that is pressed and then sintered, where the sintering is performed at high temperature, usually within the range of 815.6° C. to 1037.8° C. (1500 to 1900° F.).

U.S. Pat. No. 6,536,352 describes the powder of a matrix metal with a high melting point and a metal powder with a melting point substantially below that of the matrix metal, in short, the teachings of this document require two metal powders of different characteristics.

Another document of the prior art is U.S. Pat. No. 6,090,178, where the bullet is made of a plurality of metal particles and a binder that breaks easily, consisting essentially in an intermetallic that can be a metal or metalloid such as tin, zinc, gallium, silicon, arsenic or aluminium, for example. Once again, two different metallic materials are used to manufacture the bullet.

Similarly, U.S. Pat. No. 6,263,798 describes a cartridge where the bullet is formed by a plurality of metal particles consisting of unsintered copper and tin that are bound to one another using a binder that breaks easily, consisting essentially of an intermetallic compound of copper and tin.

Other documents of the prior art relating to compositions for bullets are described in U.S. Pat. No. 5,399,187 and U.S. Pat. No. 5,760,331, where the composition includes tungsten W. Additional compositions are also described in U.S. Pat. No. 5,894,644; U.S. Pat. No. 6,551,375; and U.S. Pat. No. 5,950,064, where the composition of the bullet is based on FeW with different additions of W and even Portland cement.

Even U.S. Pat. No. 6,569,381; U.S. Pat. No. 6,815,060; U.S. Pat. No. 6,016,754; and U.S. Pat. No. 6,439,124 describe bullets manufactured from compositions having W—Sn with or without a sheathe or jacket.

U.S. Pat. No. 5,237,930 describes a very fine powder using non-coarse copper and a thermoplastic resin such as Nylon 11 or 12 (Polyamide) and with densities of about 5.7 g/cm$^3$ as materials to manufacture frangible bullets.

Similarly, U.S. Pat. No. 7,353,756; discloses a polyether binder in 30-40% by weight with low density for frangible bullets. U.S. Pat. No. 5,442,939 discloses another composition using stainless steel with Fe and with 2% of graphite to help break the ammunition. U.S. Pat. No. 5,950,064 proposes liquid phase sintering to gain density using FeW—Fe—Zn.

As can be observed, technologies exist for the manufacture of frangible bullets, but there is still the need for new compositions and methods that represent reliable alternatives for the manufacture of frangible bullets

BRIEF DESCRIPTION OF THE INVENTION

This invention has as an object to provide a new frangible bullet, which according to the invention comprises pressed particles of a copper-based metal powder where the particles have been pressed with the aid of an organic lubricant and have been treated in an oxidizing medium, preferably in the presence of air, at temperatures of no more than 400° C., the pressed particles have a density of more than 6.9 g/cm$^3$ and it is preferred that the pressed particles have a density of 7.2 g/cm$^3$ to 7.5 g/cm$^3$.

The copper-based particles used for the bullet preferably have a size of more than 120 micrometres.

The organic lubricant used for the pressing is preferably a polymer of the polyethylene, polyamide or polyvinyl alcohol families, more preferably using partially oxidised high-density polyethylene as a lubricant.

Another aspect of the invention provides a method for the manufacture of a frangible bullet comprising the steps of providing a copper-based metal powder; the powder particles are then pressed with the aid of an organic lubricant until a density of more than 6.9 g/cm$^3$ in order to favour cold welding of the particles, preferably using a weight ratio of less than 1% by weight of the lubricant with respect to the metal powder to be pressed. The pressed particles are then subjected to an oxidative heat treatment in order to allow physical bonds of the polymer chains with oxygen, which oxidation is performed with air. In this step there is also growth of the oxidised layer of the pressed particles.

The invention allows the manufacture of bullets at low cost that are frangible. Especially, the bullet can be sheathed and allows deformation in order to be anchored into the bullet case. The bullet also has suitably fragile bonds in order to break up into very small sizes and weights when the bullet impacts the target surface.

BRIEF DESCRIPTION OF THE DRAWINGS

As a complement to the description being made and in order to aid towards a better comprehension of the features of the invention, according to a preferred practical embodiment thereof, we incorporate as an integral part of this description a set of drawings that are illustrative and not limiting in nature and represent the following:

FIG. 1 shows a side view of a 9 mm gauge frangible bullet manufactured according to a preferred embodiment of this invention.

DETAILED DESCRIPTION OF THE PREFERRED EMBODIMENTS OF THE INVENTION

The invention relates to a new frangible bullet comprising particles of a copper-based (Cu) metal powder that have been pressed with the aid of an organic lubricant. This copper powder is especially preferred to be bronze or brass, with a content of less than 41% by weight of Zn and/or less than 12% by weight of tin. The powder particles have irregular shapes with a size grading of more than 120 micrometres. It is important to explain that the metal powder used in this invention consists of pre-alloyed particles of Cu—Zn—Sn, that is, the powder is not a mixture of separate particles of Cu, Zn and Sn.

The organic lubricant is preferably a polyethylene lubricant, more preferably partially oxidised high-density polyethylene. Similarly, other polymers, such as polyamides or polyvinyl alcohols, can be used as lubricants for the purposes of this invention. A weight ratio of less than 1% by weight of the lubricant with respect to the metal powder is used for the pressing.

The method of the present invention starts form providing copper-based particles that will then be pressed with the aid of an organic lubricant up to a density of more than 6.9 g/cm$^3$, preferably in the range of 7.2 g/cm$^3$ to 7.5 g/cm$^3$, which thus achieves enough toughness for the projectile to be sheathed; and adequate embrittlement so that the energy absorbed in the impact is sufficient to break the projectile material according to the frangibility parameters.

During the compaction of the high-density powder there is breakage of the oxidised layer of the bronze or brass and intimate contact between the particles of this material, which favour the cold welding of the composition. The more irregular the copper-based powder the more cold binding points generated in the composition during the high-pressure pressing.

Once the composition has been pressed, the following step in the method is to subject the pressed particles to thermal oxidation at temperatures of not more than 400° C. for times that allow physical bonds of the polymer chains with oxygen, preferably the oxygen in the air, as well as growth of the oxidised layer of the metal alloy that allows sufficient binding between the different particles of the material in order to maintain the integrity of the component during the sheathing and firing processes, but not enough to maintain its integrity after impact.

Furthermore, during the oxidative heat treatment the oxide layer that has grown in contact with the pressed material serves as a kinetic barrier with respect to the cold welding points, which remain intact.

The joint growth of the oxide layer is favoured by the growth characteristics of copper oxide, with slow kinetics at low temperature. The organic lubricant, which is preferably polyethylene, incorporates oxygen into its chain thus becoming cross-linked and hardening.

The set of effects described above, the high-density pressing and thermal oxidation, facilitate on the one hand sufficient resistance and plasticity of the material in order to be able to sheathe the bullet and for it to be deformed in order to be anchored into the bullet casing, as well as suitable embrittlement of the bonds in order for it to break up into very small sizes and weights when the projectile impacts upon the target surface.

The composition processed in this way is finally finished by means of surface mechanical processes, preferably by barrelling in order to reduce burrs produced by the plastic straining of the material during pressing.

The frangible bullet of this invention will be more clearly illustrated by the examples described below, which are provided here for purposes of illustration, but not limiting the scope of the invention, said examples being following:

EXAMPLE 1

A batch of frangible bullets of gauge 40 was prepared starting from a homogeneously pre-alloyed composition of 84% of Cu, 6% of Zn, 9% of Sn and 1% of impurities, with the addition of 0.6% of high-density polyethylene as a pressing lubricant. The typical dimensions of this bullet can be seen in FIG. 1: Bullet casing diameter 9.0 mm, length 16.64 mm and diameter of the tip 2.03 mm The bullets of this batch were subjected to the tests indicated below:

Revolver Test

20 Bullets from this batch were fired from a revolver and did not fragment until impact. After impact the largest particles recovered from the nose of the bullet weight 2.5 grains and the particle from the base of the projectile weighed 2.4 grains. The size of the particles recovered was considered adequate, since the maximum admissible in this test must be less than 5.0 grains.

Submachine Gun Test

The following test the bullets were subjected to was being fired in a submachine gun, which has a more aggressive firing operation at greater speeds than with a revolver. None of the 115 shells fired showed any signs of stripping.

Loading Test

All the rounds tested were loaded in an automatic equipment and did not show any problems during the loading process.

Firing in Pressurised Equipment

The shells were then fired in pressurised equipment. The speed and pressure were the same as for the shells manufactured with the sintering technique of the prior art. The objective of this test was to fire a bullet into a standard-sized gelatine block from a very short distance and to see how it fragments. The bullet fragmented by the impact stayed inside the block, and the transparent gelatine allowed observing in detail its condition once fragmented, which was considered acceptable.

Firing Scatter Test.

A test with standard equipment to measure firing scatter was subsequently performed. The test was performed against a target the surface of which was divided into square inches. A group of 10 bullets was shot from a distance of 22.86 meters (25 yards). The test is considered satisfactory if all the bullets impact the target within an area of 12.9 $cm^2$ (2 square inches) at the most. The bullets passed the test without problems.

Wear Tests

The remaining shells were placed in a bullet carousel in order to determine whether or not they passed the rotation action. The shells were rotated for one hour with samples taken every 10 minutes. The shells showed no signs of wear.

Hollow Point Test

The next test consisted in boring a hole into the bullet (hollow point—HP). For this test the bullets were modified with different HP depths. The results after firing into gelatine showed the same performance as shells manufactured by the sintering methods of the prior art.

Vibration Action

The bullets were placed on a vibrating table in order to determine whether or not they passed the vibration action of the machine. The shells showed no signs of damage.

The bullets were then fired in order to verify any micro-fractures that might have appeared during the vibration test. The bullets showed no signs of stripping or wear.

In view of this description and set of figures, a person skilled in the art will understand that the embodiments of the invention described may be combined in multiple manners within the object of the invention.

The invention claimed is:

1. A method for producing a frangible bullet, comprising:

providing a copper-based metal powder with a particle size distribution of more than 120 micrometers;

pressing the particles of the powder with the aid of an organic lubricant up to a density of more than 6.9 $g/cm^3$, wherein the organic lubricant is a polymer selected from the group comprising polyethylenes, polyamides or polyvinyl alcohols, thereby favoring the cold welding of the particles; and subjecting the pressed particles to an oxidative heat treatment thereby allowing physical bonds between polymer chains in the organic lubricant and oxygen as well as the growth of an oxidised layer on the pressed particles.

2. A method for producing a frangible bullet according to claim 1, wherein the heat treatment is performed at a temperature of less than 400° C.

3. A method for producing a frangible bullet according to claim 1, wherein the heat treatment is performed in the presence of air.

4. A method for producing a frangible bullet according to claim 1, wherein during pressing up to 1% by weight of the organic lubricant is used with respect to the metal powder.

5. A method for producing a frangible bullet according to claim 1, wherein the copper-based powder is bronze or brass.

6. A method for producing a frangible bullet according to claim 1, wherein the pressed particles have a density of about 7.2 $g/cm^3$ to about 7.5 $g/cm^3$.

7. A method for producing a frangible bullet according to claim 1, wherein the organic lubricant is high-density polyethylene.

8. A method for producing a frangible bullet according to claim 1, wherein the copper-based powder consists in particles of a homogeneous pre-alloy of copper, tin and zinc, with a content of less than 41% by weight of Zn and/or less than 12% by weight of Sn.

* * * * *